United States Patent [19]

Popkes et al.

[11] 4,062,449

[45] Dec. 13, 1977

[54] SKIN PACKAGE WITH TRANSPARENT BACK WINDOW

[75] Inventors: Elvin B. Popkes, Burnsville; Gary E. Olson, Brooklyn Center, both of Minn.

[73] Assignee: Opportunity Workshop, Inc., Minnetonka, Minn.

[21] Appl. No.: 734,293

[22] Filed: Oct. 20, 1976

[51] Int. Cl.[2] ..... B65D 73/00; B65B 11/52

[52] U.S. Cl. ..... 206/471; 53/22 A; 206/45.34

[58] Field of Search ..... 206/461, 462, 463, 45.31, 206/45.33, 45.34, 471; 53/22 A, 30

[56] References Cited

U.S. PATENT DOCUMENTS

| | | | |
|---|---|---|---|
| 2,861,405 | 11/1958 | Hanford | 206/471 X |
| 3,090,484 | 5/1963 | Scholl | 206/461 |
| 3,202,278 | 8/1965 | Taylor | 206/471 |
| 3,307,693 | 3/1967 | Bittner | 206/461 |
| 3,380,583 | 4/1968 | Goodman | 206/471 |
| 3,433,694 | 3/1969 | Nuttall | 206/471 X |
| 3,507,383 | 4/1970 | Rorer | 206/471 |
| 3,734,798 | 5/1973 | Dooley | 206/461 X |
| 3,784,004 | 1/1974 | Meyer | 206/471 |
| 3,796,306 | 3/1974 | Swezey | 206/471 X |
| 3,803,332 | 4/1974 | Seiferth | 206/45.31 X |

*Primary Examiner*—Stephen Marcus
*Attorney, Agent, or Firm*—Burd, Braddock & Bartz

[57] ABSTRACT

A skin package having a single backing board having an adhesion-promoting coating on one side, an opening through the board, a transparent window covering that opening and a transparent heat-sealable thermoplastic film extending over the board and covering product disposed over and displayed through the window. The backing board with its adhesion-promoting coating is permeable to the passage of air. The material of which the transparent window is formed is in most cases substantially impermeable to the passage of air. It covers all of the window but substantial gas-permeable area around the window remains. The window is preferably heat sealed to the adhesion promoting layer. The top film, which may be either preformed or extruded in situ, is vacuum drawn around the product displayed and is heat sealed.

10 Claims, 2 Drawing Figures

SKIN PACKAGE WITH TRANSPARENT BACK WINDOW

BACKGROUND OF THE INVENTION

1. Field of the Invention

This invention is directed to a skin package of the type used to visibly display merchandise for sale on racks or counters, especially in self-service stores. The package of the present invention is characterized by having a transparent window such that the commodity packaged is visible from both sides of the package. The goods are packaged between transparent films supported on a single backing board. The protective vacuum drawn film covering the goods is heat sealed. Excessive vacuum draw-down of the film over the goods is avoided.

2. The Prior Art

The patent literature is replete with references dealing with packaging of articles under a thermoplastic sheet or film. One early method comprised providing a supporting panel coated on one side with adhesive and provided with a plurality of holes. The article to be packaged is placed on the panel, a heated thermoplastic sheet is draped over the article and the air is exhausted from between the sheet and the article by means of suction applied to the underside of the supporting panel. The air is withdrawn solely through the holes since the adhesive coating functions as a barrier to the passage of air.

Groth U.S. Pat. No. 2,855,735 discloses a similar coating process in which an air permeable supporting panel without such drilled or punched holes is supplied with an adhesive coating applied in a non-continuous manner. According to this method, air may pass through the non-coated areas of the supporting panel in the course of drawing the heated thermoplastic covering into tight engegement with the article to be covered. However, neither of these prior art processes make provision for a package from which the article is visible from both sides. Also, the bonding of the protective film is limited to those areas covered by adhesive, and, in many cases, there is excessive draw-down of the thermoplastic film over the goods being packaged making removal difficult.

Bittner U.S. Pat. No. 3,307,693 discloses a package in which a supporting panel is provided with an opening covered by a transparent film. The product to be packaged is placed over the resulting window and enclosed in a preformed transparent film bowl which is pasted or welded to the supporting panel. While this package has the advantage of permitting viewing of the packaged goods from both sides, the use of preformed transparent bowls to cover the goods and fastening of those bowls involves processing steps which materially add to the expense of the package.

SUMMARY OF THE INVENTION

Broadly stated, the present invention is directed to a skin package enclosing a product for display and sale which comprises a flat air permeable backing sheet having a front face and a back face with a thin adhesion-promoting transparent coating of thermoplastic material applied continuously over the front face of the sheet. An opening appropriate to the product to be displayed is provided in the backing sheet. A first transparent precut flat film is applied over the opening, preferably on the front face of the backing sheet, and preferably adhered to the adhesion-promoting coating and the backing sheet. In most cases the window film is substantially air impermeable. The product to be packaged is then placed over the resulting window and a further protective transparent thermoplastic resinous film, either preformed and heat softened or formed in situ, is laid over the product, drawn down by suction applied to the back of the backing sheet and heat sealed to the adhesion-promoting coating and backing sheet. Because the film covering the window opening is substantially impermeable to the passage of air, sufficient uncovered area around the opening must be provided to permit drawing of the uppermost film against the product and backing sheet. Because the window film performs a vacuum blocking function, excess draw-down of the top film upon the product is avoided. The invention also includes the method by which the package is formed.

BRIEF DESCRIPTION OF THE DRAWINGS

The invention is illustrated in the accompanying drawings in which corresponding parts are identified by the same numerals and in which:

FIG. 1 is a schematic flow sheet showing the steps by which the package is formed and showing the structure of the package at each step.

DESCRIPTION OF THE PREFERRED EMBODIMENT

Figure 7:
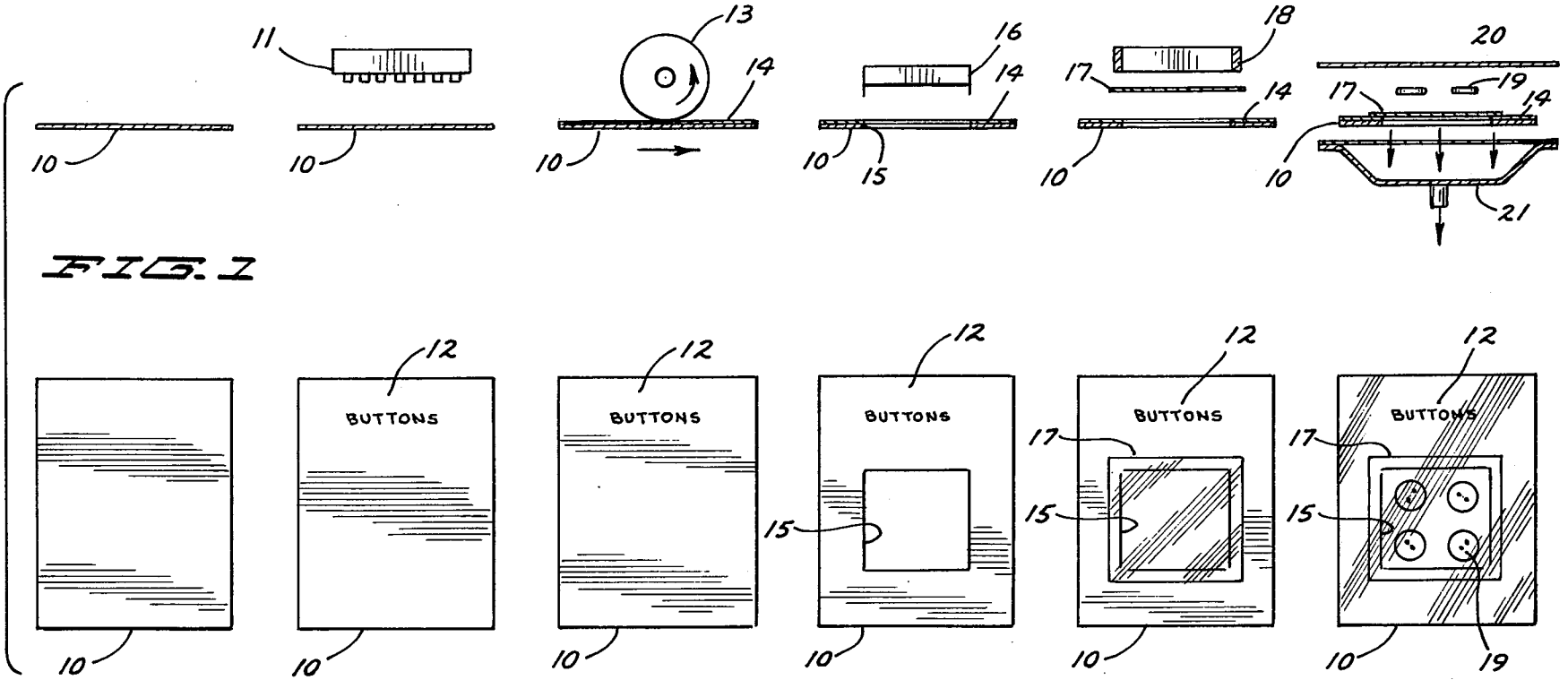

Referring to the drawings, the package begins with a flat air permeable supporting panel or backing sheet 10, such as paper or paperboard, or corrugated board, of size, thickness and stiffness appropriate to the product to be packaged. For example, relatively small lightweight articles (such as a single coin) may be packaged using relatively lightweight paper stock of small dimensions, whereas a relatively larger and heavier object (such as a ⅝ inch drill) requires heavier stock. Typical backing sheet stock may range between about 0.018 inch (18 point) and 0.048 inch (48 point). To preserve the porosity, the backing sheet is preferably uncoated or has only a light clay coated surface. So-called "cylinder board" or solid bleached sulphate paperboard are representative of backing sheets which may be used. Typical paperboard used for consumer packages is 26 point cylinder board (i.e., Sealtone-PCA).

The backing sheet stock is imprinted by any suitable conventional printing means, indicated schematically at 11, to apply identifying and decorative indicia 12 to the front face of the backing sheet, generally in two or more colors. Typically four color process printing by the litho or offset method is used for quality packaging.

An extremely thin transparent adhesion-promoting coating of thermoplastic resinous material is applied continuously over the printed front face of the backing sheet. A preferred thermoplastic material is an ionomer polyolefin (such as the aqueous suspension of fine particles sold by du Pont as 56250 Surlyn Ionomer Dispersion Primer), although other thermoplastics such as cellulose acetate, cellulose acetate-butyrate, vinyl chloride, vinyl acetate, etc., may also be used. The adhesion-promoting coating 13 is applied, as by a roller applicator 14, or by spraying as a solution or a fine dispersion in a liquid carrier.

Preferably part of the adhesion promoting coating 14 penetrates into the surface of the backing sheet. Although applied continuously over the front face of the backing sheet, the coating itself is preferably air permeable so as not to destroy the air permeability of the backing sheet. However, if the backing sheet or the adhesion-promoting coating is impermeable to the passage of air, the coated sheet may be perforated to provide minute air passages, as is well known in the art.

The imprinted coating backing sheet is then provided with an opening 15 as by means of a cutting die 16. The opening 15 is of a size and shape appropriate to the goods being packaged. Although the opening generally is rectangular, preferably with rounded corners for improved appearance, it may also be some other polygonal shape, round, oval, etc., as appropriate to the goods. At the same time, the backing sheet may be perforated near or around the opening to facilitate opening of the package. Preferably the backing sheet 10 is first coated and then die cut. However, these steps may be reversed.

A transparent resinous sheet or film 17 is applied over opening 15 forming a transparent window. The window film 17 is precut and of a size slightly larger than opening 15 and generally of the same shape, although the precise shape is not critical. However, the window film, which in most cases is substantially impermeable to the passage of air, should preferably cover no more of the face of the backing sheet than is necessary to cover the window and to be secured to the backing sheet. The remainder of the backing sheet should be uncovered so as to remain porous. Typically the window film will be about 0.003 to 0.010 inch thick, and about ¼ to ⅜ inch wider on its perimeter than the window cutout on all sides. The window film is preferably thermoplastic and of a resin compatible with that of the adhesion-promoting coating. Preferably the window film 17 is adhered by heat sealings as by heated sealing bars 18 or a heated plate, preferably Teflon covered to prevent sticking. Alternatively, the window film may be adhered by use of conventional adhesive or, in some instances, it may not be separately affixed, being held by the overlying skin film. Although the window film generally is flat, in some cases, depending upon the product to be packaged, it may be preformed to the appropriate shape.

The goods to be packaged, here shown as buttons 19, are laid over the transparent window film and a heat softened outer protective film 20 is applied over the entire card and drawn by suction applied to the back face of the backing sheet, as by vacuum box 21 connected to a vacuum pump or other source of suction. Film 20 may be preformed and heat softened, or it may be formed in situ and applied as a film curtain. In either case, the film 20 is drawn around the goods and into tight adherence with the edge of window film 17 and all of the front face of the backing sheet uncovered by the window film.

When the vacuum has removed the air so that all parts of the bubble of air within the window are inside of the perimeter of the window, then the air will no longer be exhausted as the path of removal has been blocked. If it is desired to completely draw the film around the product, then either the window should be shaped accordingly or a hole can be punched in the window for air exhaustion. The process of stopping air exhaustion when desired is called vacuum blockout. This is particularly useful for product such as fishing lures and springs. Although shown in FIG. 2 as distinct layers, the films tend to merge and coalesce with the adhesion-promoting coating 14. Film 20 is transparent and compatible with the adhesion-promoting coating and preferably also with the window film 17. Upon cooling, the package is complete. Generally the backing sheet is provided with a perforation to permit hanging on a display rack.

Figure 2:
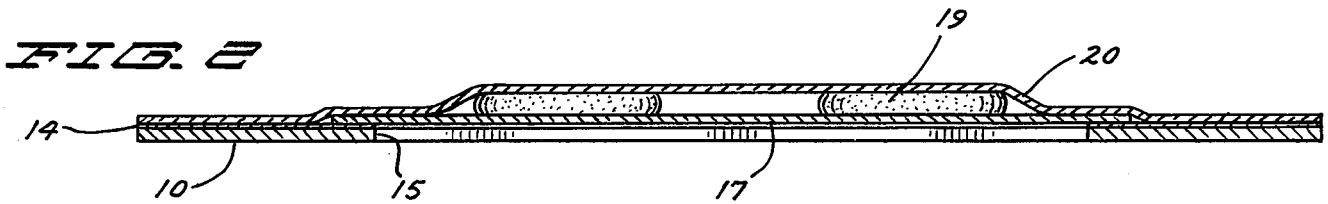
FIG. 2 is a transverse section on an enlarged scale taken on the line 2—2 of FIG. 1 showing details of the package structure.

Because the window film 17 in most instances is substantially impermeable to the passage of air, it provides a vacuum block which inhibits the protective film 20 from being drawn too closely around and into the packaged goods, as shown, for example, in FIG. 2, in the space between buttons 17, where there is little or no draw-down of the film 20. Other products such as tools (i.e., crescent wrenches) may want the air exhausted for best showing of the product to the potential customer. It will also be noted that while the goods are visible from both sides, they lie on the surface of the window film and generally do not project substantially beyond the plane of the back face of the backing sheet.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A skin package enclosing a product for display and sale, said package comprising:

A. a flat air permeable backing sheet having a front face and a back face,

B. a thin adhesion-promoting transparent coating of thermoplastic resinous material applied continuously over the front face of said sheet, C. an opening in said sheet, D. a first transparent precut window film covering said opening over the front face of said sheet, E. a product overlying said window film, F. a further protective transparent thermoplastic resinous skin film overlying and vacuum drawn around said product and heat sealed to said adhesion-promoting coating and said backing sheet, G. said transparent window film being substantially air impermeable and the area of said film being greater than that of the opening but substantially less than that of the backing sheet, whereby at least a portion of the front face of the backing sheet around the opening is uncovered by the window film and said skin film conforms generally to the surface of the product without penetration therein.

2. A skin package according to claim 1 further characterized in that the front face of the backing sheet is provided with printed indicia under the adhesion-promoting coating.

3. A skin package according to claim 1 further characterized in that said window film is heat sealed to said adhesion-promoting coating and backing sheet.

4. A skin package according to claim 1 further characterized in that the adhesion-promoting coating is air permeable.

5. A skin package according to claim 1 further characterized in that said adhesion-promoting coating and said window and skin films are formed of synthetic ionomer olefin resin.

6. A method of making a skin package enclosing a product for display and sale, said method comprising:

A. providing a flat air permeable backing sheet having a front face and a back face, B. applying a thin adhesion-promoting transparent coating of thermoplastic resinous material continuously over the front face of the sheet, C. cutting an opening in the sheet, D. applying a first transparent precut window film covering said opening over the front face of the sheet, E. placing a product to be packaged over said window film, F. applying a further protective transparent heat softened transparent skin film over said backing sheet and product, G. while still heat softened, applying suction to the back face of said sheet to draw said skin film down over said product and to heat seal said skin film to the adhesion-promoting coating and backing sheet, H. cooling the package to stabilize the skin film, I. said transparent window film being substantially air impermeable and the area of said film being greater than that of the opening but substantially less than that of the backing sheet, whereby at least a portion of the front face of the backing sheet around the opening is uncovered by the window film.

7. A method according to claim 6 further characterized in that the front face of the backing sheet is imprinted with identifying indicia prior to application of the adhesion-promoting coating.

8. A method according to claim 6 further characterized in that said adhesion-promoting coating is applied as a liquid dispersion by rolling and dried.

9. A method according to claim 6 further characterized in that said window film is affixed to said adhesion-promoting coating and backing sheet by heat sealing.

10. A method according to claim 6 further characterized in that said adhesion-promoting coating and said window and skin films are formed of synthetic ionomer olefin resin.

* * * * *